US009335024B2

(12) United States Patent
Wang He

(10) Patent No.: US 9,335,024 B2
(45) Date of Patent: May 10, 2016

(54) LENS AND LIGHT SOURCE MODULE INCORPORATING THE SAME

(71) Applicant: HON HAI PRECISION INDUSTRY CO., LTD., New Taipei (TW)

(72) Inventor: Li-Ying Wang He, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 255 days.

(21) Appl. No.: 14/056,974

(22) Filed: Oct. 18, 2013

(65) Prior Publication Data

US 2015/0003079 A1 Jan. 1, 2015

(30) Foreign Application Priority Data

Jun. 26, 2013 (TW) ..... 102122621 A

(51) Int. Cl.
*F21V 5/00* (2015.01)
*F21V 5/04* (2006.01)
*F21Y 101/02* (2006.01)

(52) U.S. Cl.
CPC ..... *F21V 5/045* (2013.01); *F21Y 2101/02* (2013.01)

(58) Field of Classification Search
CPC ..... F21K 9/58; F21V 5/045; F21Y 2101/02
See application file for complete search history.

(56) References Cited

U.S. PATENT DOCUMENTS 2,352,801 A * 7/1944 Rolph ..... B64F 1/20 220/663
7,270,454 B2 * 9/2007 Amano ..... F21S 48/215 362/328

* cited by examiner

*Primary Examiner* — Thomas M Sember
(74) *Attorney, Agent, or Firm* — Novak Druce Connolly Bove + Quigg LLP

(57) ABSTRACT

A lens includes a light incident face, a light exit face opposite to the light incident face and a plurality of annular stepwise portions formed on the light exit face. The stepwise portions are located at or near a periphery of the light exit face and each stepwise portion has an annular flat surface. A plurality of micro patterns are arranged on the flat surface of one stepwise portion to scatter light exiting from the periphery of the light exit face. A light source module incorporating the lens is also provided. The light source module includes an LED light source. Light from the LED light source enters the lens from the light incident face and leaves the lens from the light exit face after the light is divergently refracted by the lens.

16 Claims, 4 Drawing Sheets

LENS AND LIGHT SOURCE MODULE INCORPORATING THE SAME

1. TECHNICAL FIELD

The present disclosure relates generally to a lens and a light source module incorporating the lens, wherein the light source module has an improved color rendering performance and a uniform illumination.

2. DESCRIPTION OF RELATED ART

LEDs are solid state light emitting devices formed of semiconductors, which are more stable and reliable than other conventional light sources such as incandescent bulbs. Thus, LEDs are being widely used in various fields such as numeral/character displaying elements, signal lights, and light sources for lighting and display devices.

Nowadays, LED light sources are widely applied for illumination, such as being used for backlight. A traditional light source module includes a white LED light source and a lens coupled to the white LED light source. The white LED light source includes a blue LED chip and a phosphor layer encapsulating the blue LED chip.

The phosphor layer absorbs blue light emitted from the blue LED chip and re-emits yellow light, with a portion of blue light leaking through the phosphor layer. The unconverted blue light and converted yellow light combine to produce a white light. However, the periphery of the white LED light source tends to be slightly blue due to uneven phosphor distribution around the blue LED chip, which weakens the light color rendering performance of the light source module and the uniformity of the light from the light source module. Therefore, such a lens and a light source module using the lens are difficult to satisfy the requirements of high color rendering performance and uniformity of brightness.

What is needed therefore is a lens and a light source module incorporating the lens which can overcome the above mentioned limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
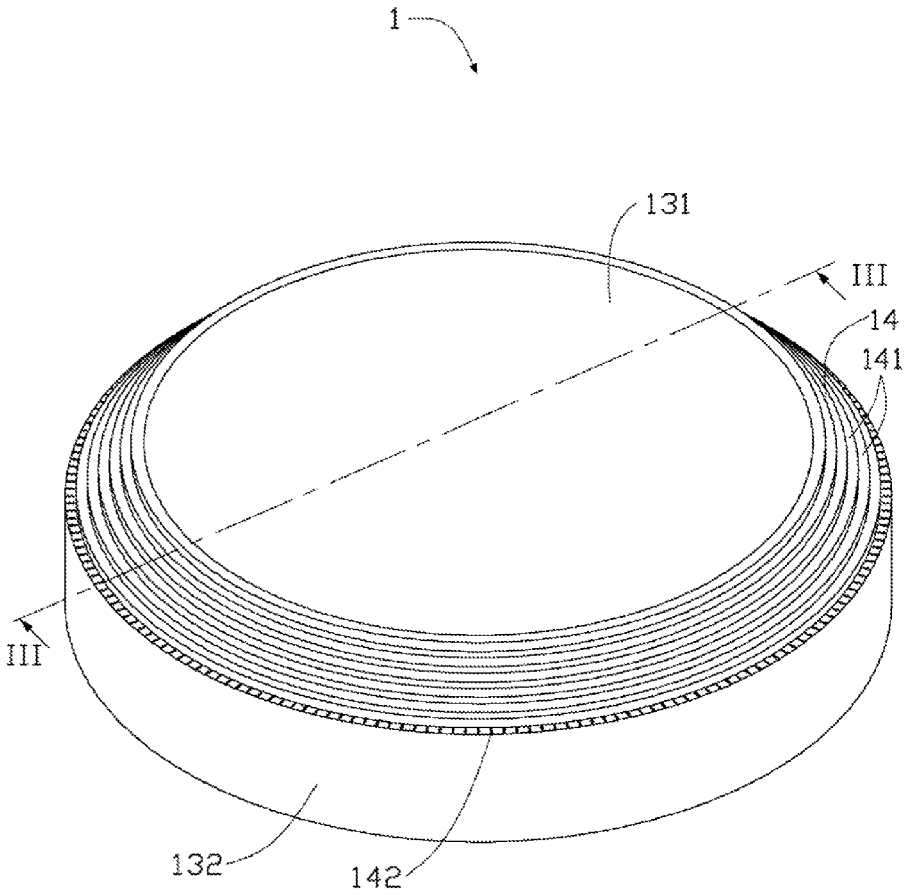
FIG. 1 is an isometric, perspective view of a light source module in accordance with an exemplary embodiment of the present disclosure.
Figure 2:
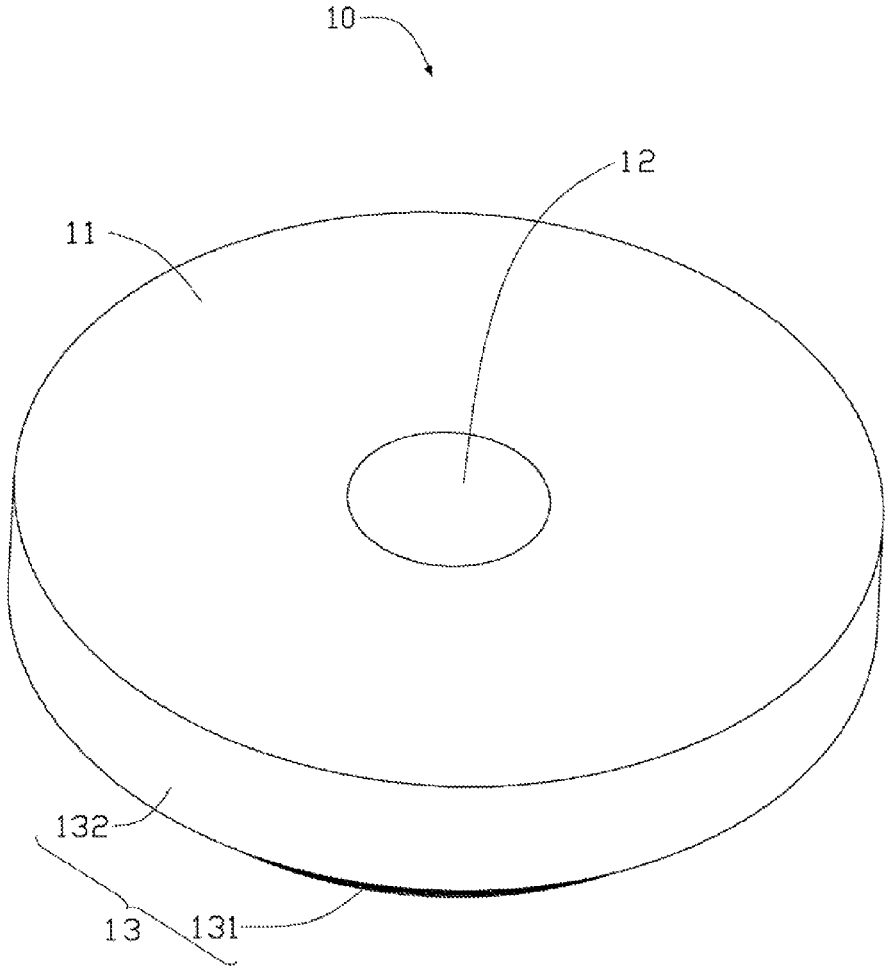
FIG. 2 is an inverted view of a lens of the light source module of FIG. 1.
Figure 3:
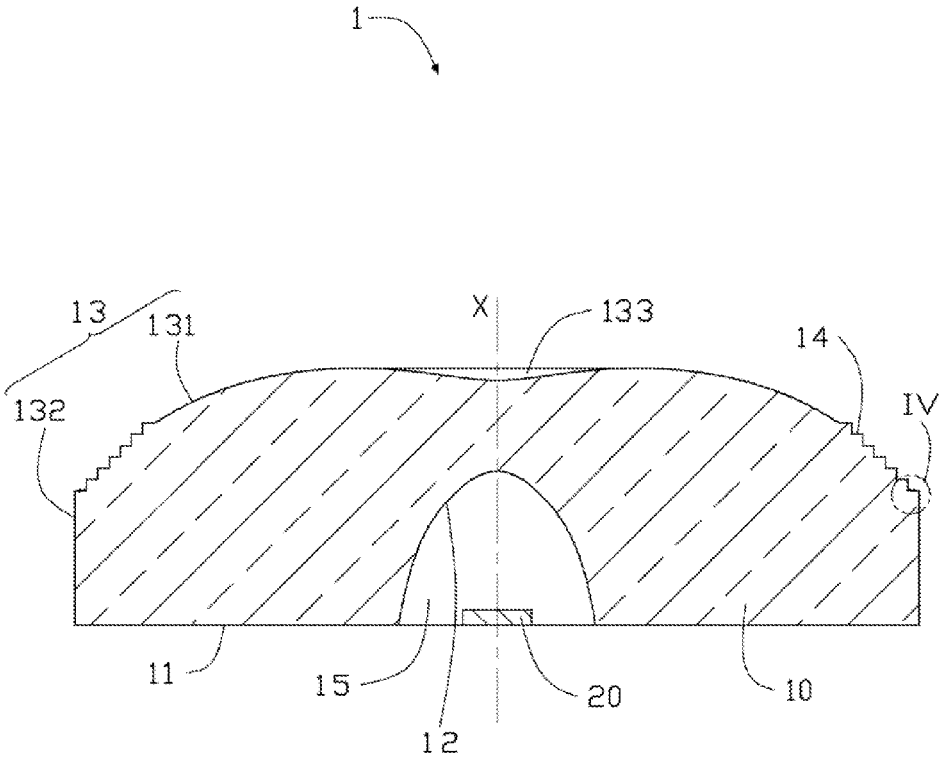
FIG. 3 is a cross-sectional view of the light source module of FIG. 1, taken along line III-III thereof.
Figure 4:
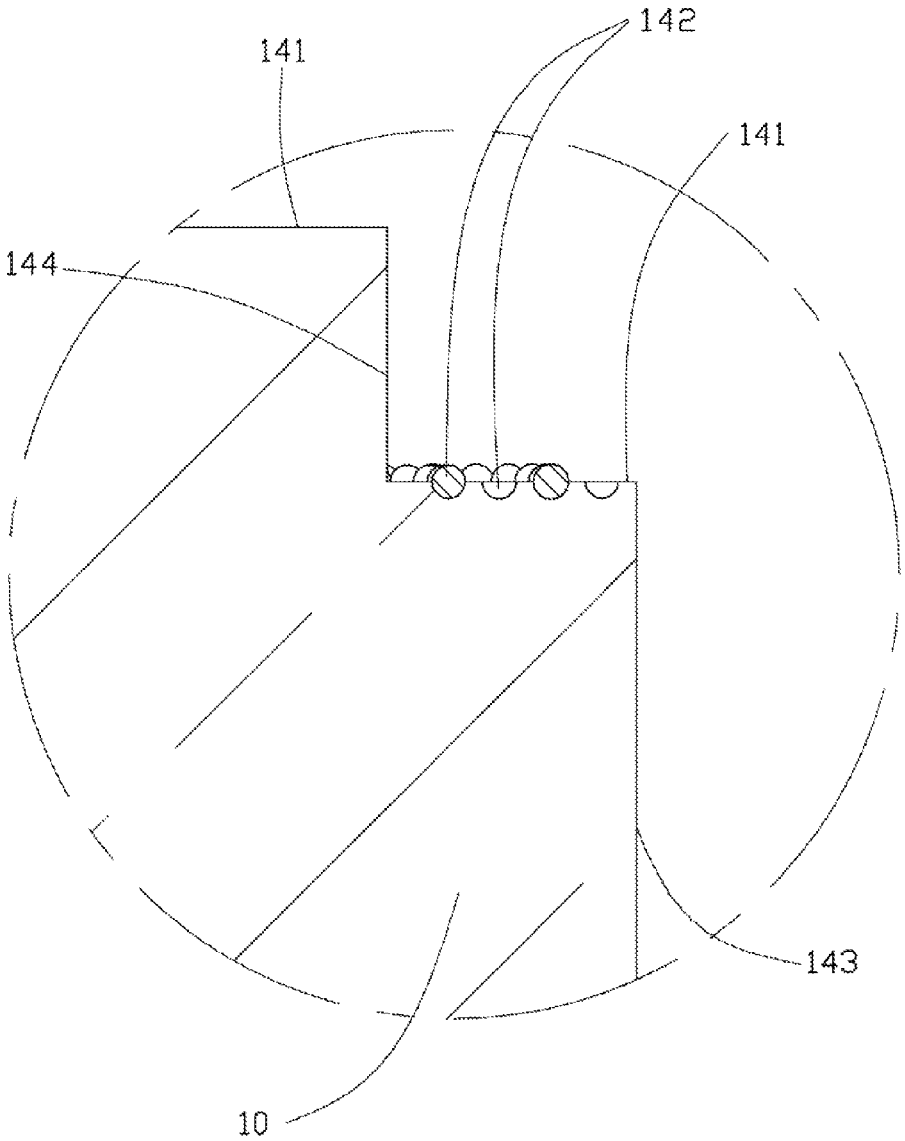
FIG. 4 is an enlarged view of part IV of FIG. 3.

Referring to FIGS. 1-4, a light source module 1 in accordance with an exemplary embodiment of the present disclosure includes a lens 10 and an LED light source 20 coupled to the lens 10. The lens 10 includes a light incident face 12, a light exit face 13 opposite to the light incident face 12 and a plurality of annular stepwise portions 14 formed on the light exit face 13. The plurality of the stepwise portions 14 are located at or near a periphery of the light exit face 13. Each stepwise portion 14 has an annular flat surface 141. A plurality of micro patterns 142 are formed on the flat surface 141 of the outmost stepwise portion 14 to scatter a portion of light exiting from the periphery of the light exit face 13. Light from the LED light source 20 enters the lens 10 from the light incident face 12 and leaves the lens 10 from the light exit face 13 after the light is divergently refracted by the lens 10.

The lens 10 includes an annular connecting face 11. The connecting face 11 interconnects the light incident face 12 and the light exit face 13. The light incident face 12 is located at a center of the connecting face 11. The light incident face 12 is recessed inwardly from an inner periphery of the connecting face 11 toward the light exit face 13. The light incident face 12 and the connecting face 11 cooperatively define a receiving space 15 for receiving the LED light source 20 therein.

The LED light source 20 is received in the receiving space 15 and faces the light incident face 12 of the lens 10. In the present disclosure, the light incident face 12 is a concave face and is radially symmetrical relative to an optical axis X of the lens 10. The light exit face 13 is a convex face and is also radially symmetrical relative to the optical axis X of the lens 10. The LED light source 20 is located at the optical axis X of the lens 10. That is to say, an optical axis of the LED light source 20 coincides with the optical axis X of the lens 10. A distance between the light exit face 13 and the light incident face 12 increases firstly and then decreases gradually in a radial direction from the optical axis X of the lens 10 to the periphery of the light exit face 13 of the lens 10.

In the present embodiment, the light incident face 12 of the lens 10 is a part of an ellipsoid and a major axis of the ellipsoid constructing the light incident face 12 is collinear with the optical axis X of the lens 10. In another embodiment, the light incident face 12 of the lens 10 could be a part of a sphere or a paraboloid.

The light exit face 13 includes a primary light exit face 131 and a secondary light exit face 132. The secondary light exit face 132 extends upwardly from an outer periphery of the connecting face 11. The secondary light exit face 132 is cylindrical. The primary light exit face 131 bends inwardly and upwardly from a top periphery of the secondary light exit face 132. A central portion of the primary light exit face 131 is recessed inwardly toward the light incident face 12 to define a recess 133.

Each stepwise portion 14 further includes a first cylindrical wall 143 extending downwardly from an outer periphery of the annular flat surface 141 thereof, and a second cylindrical wall 144 extending upwardly from an inner periphery of the annular flat surface 141 thereof.

The plurality of stepwise portions 14 connect with each other one by one from the secondary light exit face 132 to the primary light exit face 131. That is to say, two adjacent stepwise portions 14 share a common cylindrical wall, which is not only a first cylindrical wall 143 of an upper stepwise portion 14 but also a secondary cylindrical wall 144 of a lower stepwise portion 14 immediately adjacent to the upper stepwise portion 14. The flat surfaces 141 of the plurality of stepwise portions 14 are arranged in a series of concentric annuluses surrounding the optical axis X of the lens 10. An inner diameter of the flat surface 141 of each stepwise portion 14 increases along the optical axis X of the lens 10 from the light exit face 13 to the light incident face 12. The plurality of stepwise portions 14 are arranged at or near a joint of the primary light exit face 131 and the secondary light exit face 132.

The plurality of micro patterns 14 are micro-protrusions and/or micro-cavities. In the present embodiment, a plurality of micro-protrusions and micro-cavities are randomly distributed on the flat surface 141 of the outermost stepwise portion 14. In another embodiment, micro-protrusions and/or micro-cavities are distributed on the flat surface 141 of each stepwise portion 14 in an alternative manner (which means that the flat surface 141 of one stepwise portion 14 is provided with micro-protrusions while the flat surface 141 of an adjacent stepwise portion 14 is provided with micro-cavities). It is preferred that the plurality of stepwise portions 14 and micro patterns 142 are formed in a manner of screen printing processes, photolithographic processes, wet etching process or the like.

In the present disclosure, a plurality of annular stepwise portions 14 are formed at or near a periphery of the light exit face 13 and a plurality of micro patterns 142 are distributed on the flat surface 141 of the stepwise portion 14 to scatter a portion of light exit from the periphery of the light exit face 13 in a variety of directions into the space around the light source module 1, thereby improving the light color rendering performance and uniformity of the light exiting from the periphery of the light exit face 13. Thus, the light source module 1 having a high color rendering performance and uniformity is obtained.

The plurality of stepwise portions 14 connect with each other in succession. Alternatively, the stepwise portions 14 can space from each other according to the actual requirements of color rendering performance and bright uniformity in another embodiment.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A lens configured for divergently refracting light from an LED (light emitting diode) light source comprising:

a light incident face configured for receiving the light from the LED light source;

a light exit face opposite to the light incident face, configured for directing the light from the LED light source away from the lens;

and a plurality of annular stepwise portions formed on the light exit face;

wherein the plurality of the stepwise portions are formed at or near a periphery of the light exit face, each stepwise portion comprises an annular flat surface, and a plurality of micro patterns are arranged on the flat surface of at least one of the stepwise portions to scatter light exiting from the periphery of the light exit face;

wherein the light incident face is a concave face and radially symmetrical relative to an optical axis of the lens, and the light exit face is a convex face and radially symmetrical relative to the optical axis of the lens; and wherein each stepwise portion further comprises a first cylindrical wall extending downwardly from an outer periphery of the annular flat surface thereof, and a second cylindrical wall extending upwardly from an inner periphery of the annular flat surface thereof.

2. The lens of claim 1, wherein the plurality of stepwise portions connect with each other one by one.

3. The lens of claim 1, wherein the flat surfaces of the plurality of stepwise portions are arranged in a series of concentric annuluses surrounding the optical axis of the lens.

4. The lens of claim 3, wherein an inner diameter of the flat surface of each stepwise portion increases along the optical axis of the lens from the light exit face to the light incident face.

5. The lens of claim 1, further comprising an annular connecting face interconnecting the light incident face and the light exit face.

6. The lens of claim 5, wherein the exit face comprises a secondary light exit face extending upwardly from an outer periphery of the annular connecting face and a primary light exit face bending inwardly and upwardly from a top periphery of the secondary light exit face.

7. The lens of claim 6, wherein the light incident face is located at a center of the annular connecting face and recessed inwardly from an inner periphery of the annular connecting face toward the light exit face.

8. The lens of claim 6, wherein the plurality of stepwise portions are arranged at or near a joint of the primary light exit face and the secondary light exit face.

9. The lens of claim 1, wherein the flat surface of at least one of the stepwise portions is the flat surface of the outermost one of the stepwise portions.

10. A light source module comprising:

an LED light source;

a lens coupled to the LED light source, the lens comprising a light incident face, a light exit face opposite to the light incident face and a plurality of annular stepwise portions formed on the light exit face, light from the LED light source entering the lens from the light incident face and leaving the lens from the light exit face after the light is divergently refracted by the lens;

wherein the plurality of the stepwise portions are located at or near a periphery of the light exit face, each stepwise portion comprises an annular flat surface, and a plurality of micro patterns are arranged on the flat surface of one stepwise portion to scatter light exiting from the periphery of the light exit face; and wherein the LED light source faces the light incident face of the lens;

wherein the light incident face of the lens is a concave face and radially symmetrical relative to an optical axis of the lens, and the light exit face of the lens is a convex face and radially symmetrical relative to the optical axis of the lens; and wherein each stepwise portion further comprises a first cylindrical wall extending downwardly from an outer periphery of the annular flat surface thereof, and a second cylindrical wall extending upwardly from an inner periphery of the annular flat surface thereof.

11. The light source module of claim 10, wherein the plurality of stepwise portions connect with each other in sequence.

12. The light source module of claim 10, wherein the flat surfaces of the plurality of stepwise portions are arranged in a series of concentric annuluses surrounding the optical axis of the lens, and an inner diameter of the flat surface of each stepwise portion increases along the optical axis of the lens from the light exit face to the light incident face.

13. The light source module of claim 10, wherein the micro patterns are micro-protrusions or micro-cavities.

14. The light source module of claim 10, further comprising an annular connecting face interconnecting the light incident face and the light exit face.

15. The light source module of claim 14, wherein the exit face of the lens comprises a secondary light exit face extending upwardly from an outer periphery of the annular connecting face and a primary light exit face bending inwardly and upwardly from a top periphery of the secondary light exit face, and the plurality of stepwise portions are arranged at or near a joint of the primary light exit face and the secondary light exit face.

16. The light source module of claim 15, wherein the light incident face is located at a center of the annular connecting face and recessed inwardly from an inner periphery of the annular connecting face toward the light exit face to define a receiving space, and the LED light source is received in the receiving space with an optical axis thereof coinciding with the optical axis of the lens.

* * * * *